United States Patent [19]

Arnold

[11] 4,057,292

[45] Nov. 8, 1977

[54] TRIM RETAINER DEVICE FOR UPHOLSTERED CUSHIONS

[75] Inventor: Harmon W. Arnold, Carthage, Mo.

[73] Assignee: Flex-O-Lators, Inc., Carthage, Mo.

[21] Appl. No.: 695,087

[22] Filed: June 11, 1976

[51] Int. Cl.[2] ..... A47C 7/02; A47C 7/18

[52] U.S. Cl. ..... 297/452; 428/98; 428/99; 297/DIG. 1; 24/152; 24/262; 24/150 B; 24/161

[58] Field of Search ..... 428/98–99; 297/452, DIG. 2, DIG. 1; 24/152, 262 R, 150 B

[56] References Cited

U.S. PATENT DOCUMENTS

| | | | |
|---|---|---|---|
| 517,306 | 3/1894 | Seher | 24/152 |
| 2,252,970 | 8/1941 | Gedris | 297/452 |
| 3,422,817 | 1/1969 | Mishkin et al. | 24/262 R |
| 3,630,572 | 12/1971 | Homier | 297/DIG. 2 X |
| 3,727,980 | 4/1973 | Tischler | 297/452 |
| 3,802,005 | 4/1974 | Arnold et al. | 297/452 X |
| 3,961,823 | 6/1976 | Caudill | 297/452 X |
| 3,988,034 | 10/1976 | Fister | 297/DIG. 1 X |

*Primary Examiner*—George F. Lesmes
*Assistant Examiner*—A. S. Thomas
*Attorney, Agent, or Firm*—John A. Hamilton

[57] ABSTRACT

A retainer device for the decorative trim sheets of upholstered cushions, particularly cushions wherein the padding material constitutes thick slabs of molded rubber or synthetic foam, constituting an elongated flexible structure molded in the padding along the base of a groove formed in the upper surface of the padding, and including a series of opposed pairs of resilient claw teeth spaced along the length of the flexible structure, a fold of the trim sheet, or a flexible secondary listing member affixed to the trim sheet, being pressed downwardly into the padding groove to be securely engaged between the pairs of claw teeth. A listing wire or other strand may be included in the listing of the trim sheet, for more secure engagement by the claw teeth, for neater arrangement of the trim sheet, and for greater ease of engagement by the teeth. The retainer also has other uses, all related generally to the attachment of trim sheets to other elements of seating structures.

10 Claims, 15 Drawing Figures

TRIM RETAINER DEVICE FOR UPHOLSTERED CUSHIONS

Figure 1:
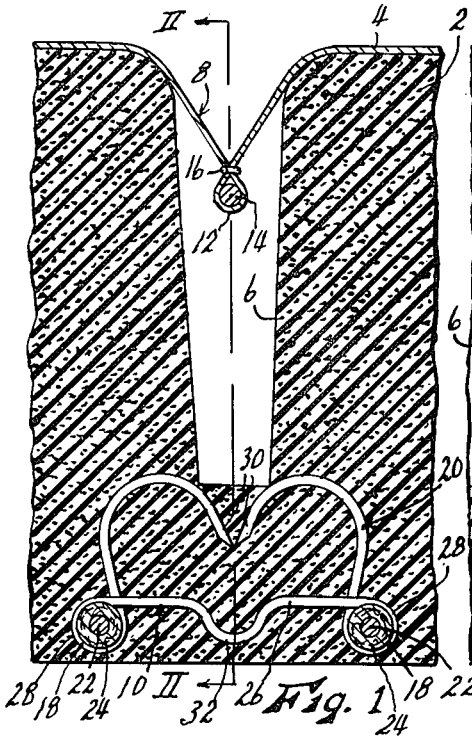

This invention relates to new and useful improvements in upholstery accessories, and has particular reference to an improved device for securing decorative trim sheets, for example fabric or pliable sheet synthetic material, over the padding material of a seat cushion or the like.

In more recent years, it has become extremely common to use molded foam forms, for example rubber or synthetic foam, as the padding or cushioning material of the seat, usually but not necessarily supported by spring decks for additional yieldability. The foam padding is usually enclosed in a trim sheet, both in the interest of a better appearance, and also to inhibit breakdown and deterioration of the foam material. Usually the trim sheet consists of a decorative textile fabric or a pliable sheet plastic or other synthetic, although it seldom consists of a single sheet, but rather a combination of a plurality of sheet, and is more accurately referred to as a "trim sheet assembly". It is usually a simple matter to turn the edges of the trim sheet assembly downwardly around the side, front and rear edges of the cushion and secure them to the rigid structure of the seat frame by ordinary means such as clips, tacks or the like, although the present special retainer also has utility in this regard. However, in certain types of seating, for example automotive seating, it has become increasingly popular to form seats wherein the upper and or seating surfaces thereof are concave in one manner or another, such as providing a cushion surface with upwardly inclined portions along the side edges thereof, to form "wings" or "bolsters," as in the common "bucket" seat. Obviously, any such concavity requires that the trim sheet be tied down to the padding material at points other than its edges, for example along the juncture lines between the main seating surface and the bolsters in the bucket seat just described, in order to preserve a smoothly taut condition of the trim sheet as required for good appearance.

Various means have been proposed for securing the trim sheet to the padding material along whatever lines may be required. The basic problem is of course that due to the local fragility of foam padding, and most other padding material as well, the trim sheet cannot be secured directly to the surface thereof. Any connection by adhesives or thermal bonding or fusion, for example, soon tear loose under the repetitive flexures and stresses of normal usage, not by failure of the adhesive or bonds themselves, but since they simply tear away and separate the surface layer of the padding. Any type of mechnical fastening device would also easily tear free from the padding. In view of this basic problem virtually all prior trim retainer systems within my knowledge have involved the molding of a deep groove in the top surface of the foam padding along any line thereof to which the trim sheet must be attached, introducing a listing member of the trim sheet downwardly into said groove, and securing said listing by mechanical fasteners to a wire fabric or other retainer member molded into the foam deeply below the surface thereof, along the bottom of said groove. The deeply embedded position of the retainer member provides that the padding will supply the structural strength to hold the trim sheet permanently in place. In some uses, the groove extends so close to the bottom of the foam pad that clip fasteners penetrating the pad at the bottom of the groove may be used to secure the listing of the trim sheet directly to elements of the spring deck underlying the pad.

The present invention involves the basic concept above described, in that it involves the introduction of a listing of the trim sheet into a deep groove formed in the form pad and its attachment to a retainer structure molded into the pad along the bottom of said groove, but differs from prior devices principally in the structure and operation of the retainer member itself. Prior retainers, usually involving merely wires or the like to which the trim sheet listing is secured by mechanical fasteners such as clips, "hog rings" or the like, have been subject to certain shortcomings and disadvantages. The clips or other mechanical fasteners are of course additional, separate items which must be supplied, and hence represent additional expense. The wires or other retainer elements to which the trim sheet must be attached are concealed since they are molded in the pad. Furthermore they are disposed at the bottom of a deep, narrow groove of the pad often several inches deep. Thus they must be "found" by the sense of touch in order to secure the fasteners thereto. This is a tedious, time-consuming operation, and hence expensive in labor costs. It is also a job requiring a considerable degree of skill, which of course further increases labor costs.

Accordingly, the principal object of the present invention is the provision of a trim retainer which overcomes all of the above enumerated shortcomings of prior devices, in that it does not require separate fasteners to secure the trim sheet listing to the retainer, in that the listing is automatically attached to the retainer whenever it is pressed into the pad groove, with no requirement that the operator "find" the retainer element by touch, so that the operation is performed easily and rapidly even by unskilled labor.

Another object is the provision of a retainer of the character described consisting of a support structure adapted to be molded into the cushion pad at the base of the cushion groove, and including a series of opposed resilient pairs of claw teeth spaced along the length of the support structure so as to be disposed generally at the base of said groove. When the trim sheet listing is pressed into the groove, it enters between the pairs of teeth, forcing the teeth of each pair of teeth laterally apart. The tooth pairs then recover elastically to pierce or otherwise engage the trim sheet to secure it in position.

Still another object is the provision of a trim retainer of the character described which is also flexible transversely of its longitudinal extent, whereby it may be configurated to lie at the bottom of a non-straight pad groove when desired.

Still another object is the provision of a trim retainer of the character described which additionally includes a listing wire or other strand adapted to be hemmed or otherwise included in the listing of the trim sheet inserted into the pad groove. Said listing wire facilitates the insertion of the listing between the claw teeth pairs, provides a more secure purchase for the claw teeth, and maintains the fold straight to prevent the trim sheet from "puckering" between the pairs of teeth.

Other objects are simplicity and economy of construction, and efficiency and dependability of operation.

Figure 2:
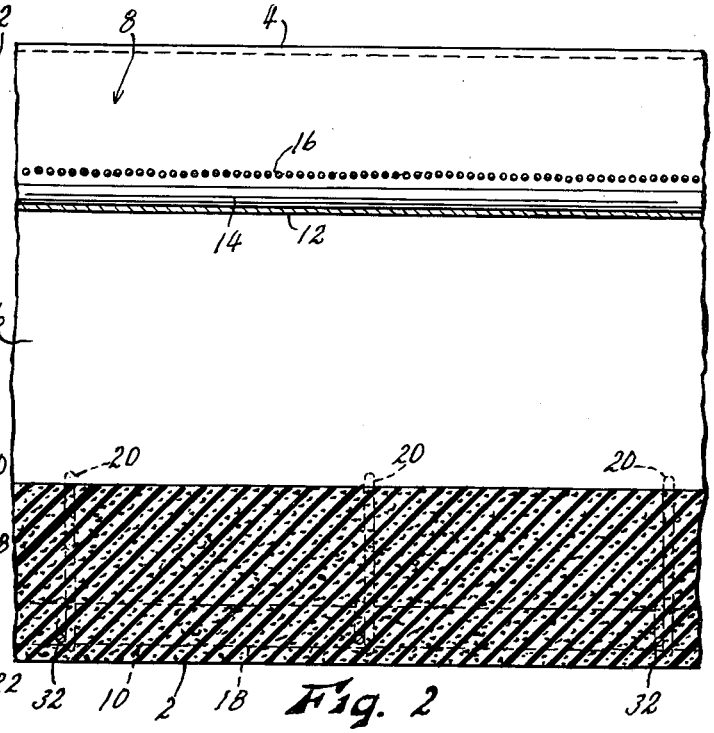
Figure 3:
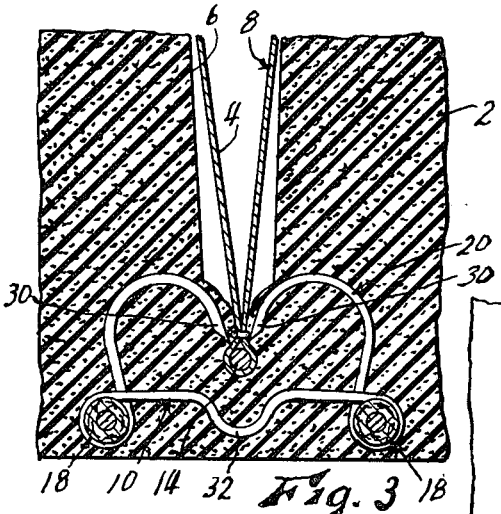
Figure 5:
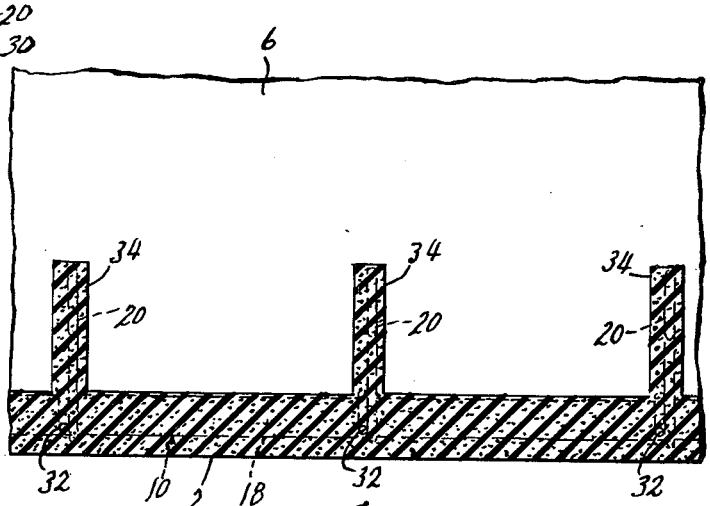
Figure 4:
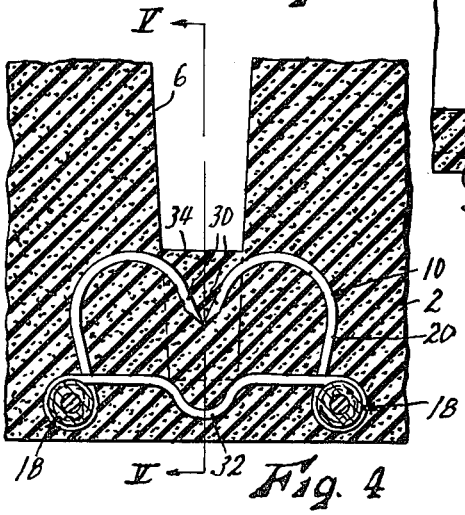
Figure 7:
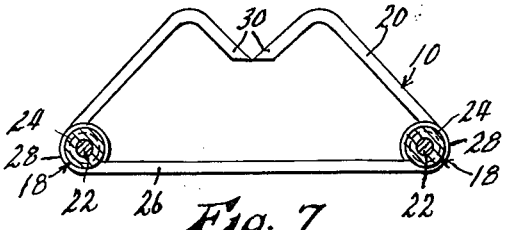
Figure 9:
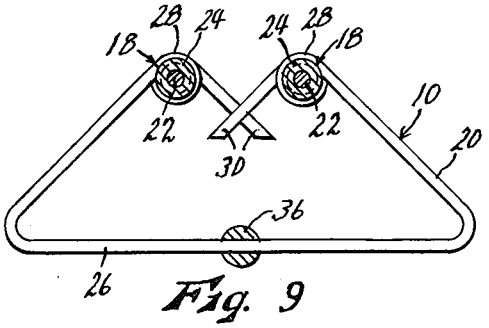
Figure 6:
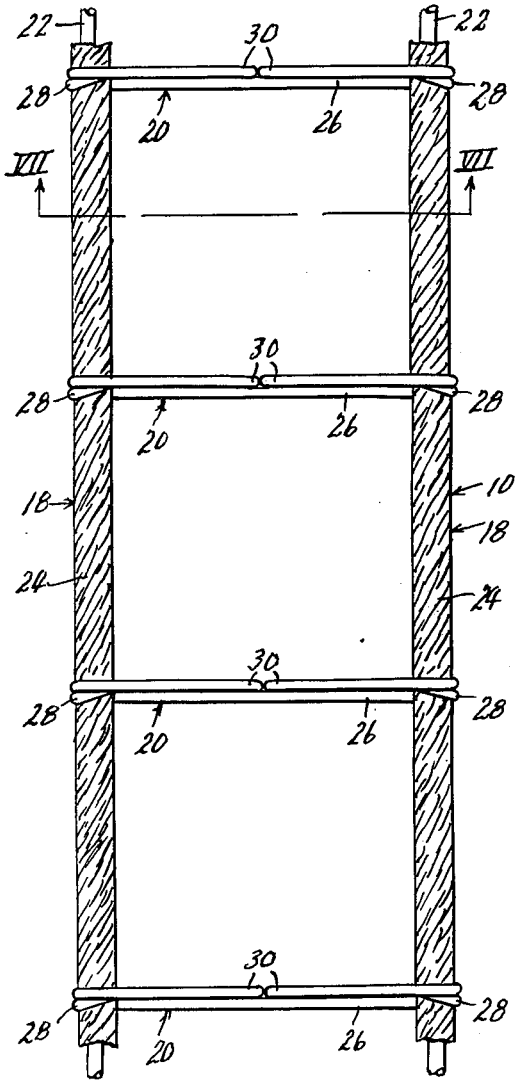
Figure 8:
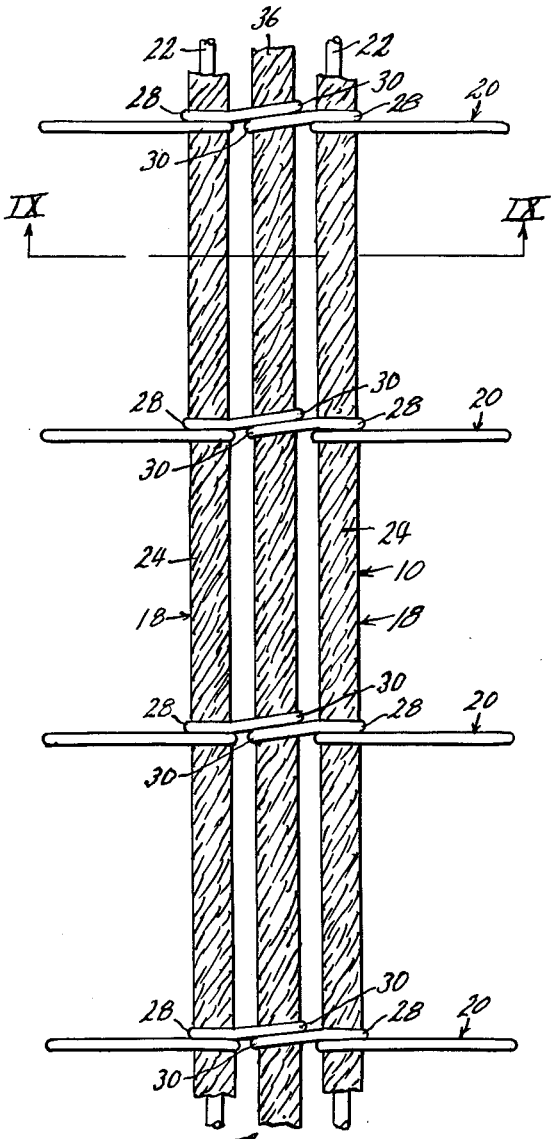
Figure 10:
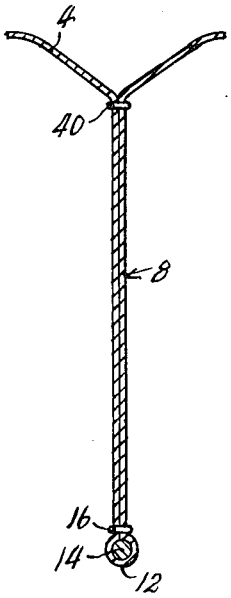
Figure 11:
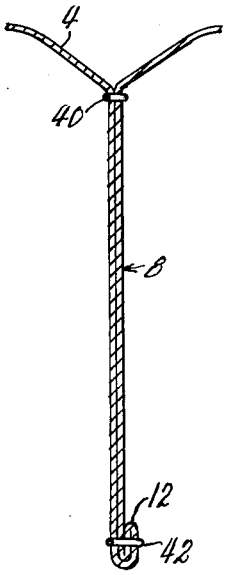
Figure 12:
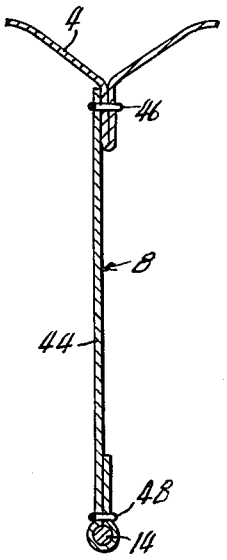
Figure 13:
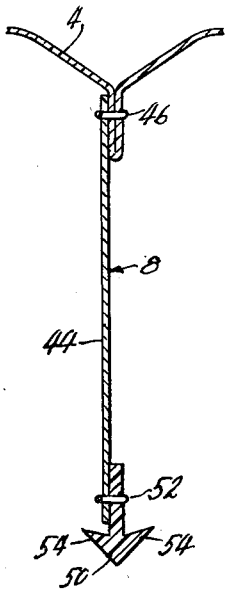
Figure 14:
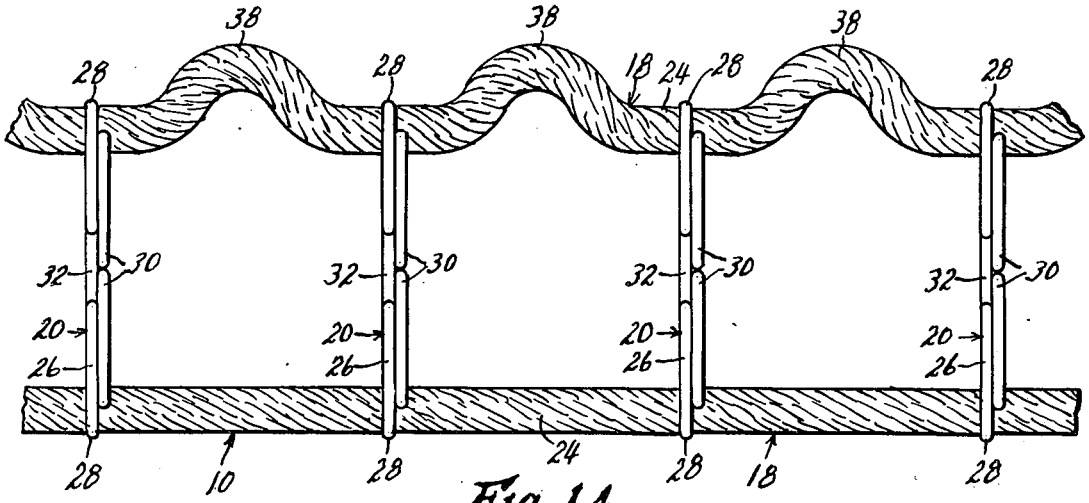
Figure 15:
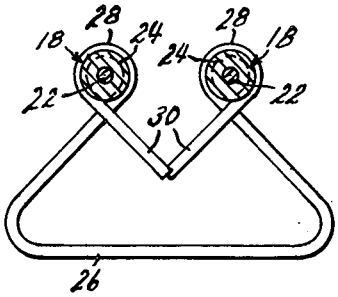

With these objects in view, as well as other objects which will appear in the course of the specification, reference will be had to the accompanying drawing, wherein:

FIG. 1 is a fragmentary vertical sectional view of a foam seat cushion pad showing a trim retainer embodying the present invention, taken transversely to said retainer, and showing the parts in a position prior to engagement of the trim sheet listing in the retainer, FIG. 2 is a fragmentary sectional view taken on line II—II of FIG. 1, FIG. 3 is a view similar to FIG. 1, but showing the trim sheet listing engaged by the retainer, FIG. 4 is a view similar to FIG. 1, with the trim sheet omitted, showing the retainer molded in a pad of slightly different configuration, FIG. 5 is a fragmentary sectional view taken on line V—V of FIG. 4, FIG. 6 is a fragmentary top plan view of a retainer assembly of a slightly modified construction, FIG. 7 is a sectional view taken on line VII—VII of FIG. 6, FIG. 8 is a fragmentary top plan view of a retainer assembly of still another modification, FIG. 9 is a sectional view taken on line IX—IX of FIG. 8, FIG. 10 is a fragmentary transverse sectional view of a trim sheet listing of modified form, FIG. 11 is a view similar to FIG. 10 but showing another listing modification, FIG. 12 is a view similar to FIG. 10 but showing still another listing modification, FIG. 13 is a view similar to FIG. 10 but showing still another listing modification, FIG. 14 is a fragmentary top plane view of a retainer assembly generally as shown in FIGS. 1 - 5, but showing a slight modification of structure, and FIG. 15 is a view similar to FIG. 9 showing a retainer assembly of a final modified form.

Like reference numerals apply to similar parts throughout the several views, and the numeral 2 applies generally to a seat cushion pad formed of foamed rubber, synthetic material or the like. Only a small section thereof is shown, although it will be understood that it may be several inches thick, and of course is horizontally configurated to the desired size and shape of the seating area. The numeral 4 designates the pliable trim sheet assembly, which includes one or more sheets one of which is a decorative fabric or synthetic film, although for convenience it is here illustrated as a single sheet, with which the pad is to be covered and substantially enclosed. For reasons discussed above it is often necessary that the trim sheet be tied down to the pad along lines thereof spaced apart from the edges of the seating surface. Along any such line, a deep groove 6 is molded in the top surface of the pad.

Generally, the trim sheet retainer forming the subject matter of the present invention involves listing 8 connected to the trim sheet along the mouth of groove 6 and depending into said groove, and a retainer assembly designated generally by the numeral 10, which is elongated and is molded into the pad along the base of the groove, and also close to the bottom surface of the pad. In FIGS. 1 - 3, the listing is formed by trim sheet 4 itself, said sheet being folded as at 12, along a line parallel to the groove, and doubled for a sufficient distance from the fold to extend from the top of the pad to the bottom of the groove for engagement by the retainer assembly, the doubled fold constituting the listing. The vertical width of the listing is of the course so determined that when it is engaged by the retainer, the trim sheet will be drawn neatly taut. Preferably, a listing wire 14 of spring steel is hemmed into fold 12 by stitching 16, said wire extending the full length of the fold. Strictly speaking, for reasons which will appear below, the listing wire should be viewed as an element of the retainer assembly, even though it actually is attached to the listing.

Retainer assembly 10, as shown in FIG. 1 - 5, is elongated to extend parallel to the base of groove 6, and is of course molded into the pad at the time of manufacture. It consists of a pair of side strands 18 and a series of divided spring wire loops 20 disposed in planes transverse to the side strands and spaced regularly along the length of said side strands. Each side strand 18 comprises a spring steel wire core 22 encased in a sheath 24 of soft, indentable material such as twisted paper, as shown, or soft plastic or the like. Each wire loop 20 constitutes a single length of spring steel wire forming a loop lying generally in a plane transverse to the side strands. The central portion 26 of the wire extends transversely between the side strands, passing above said side strands, is then wrapped tightly about sheaths 24 of said side strands, as indicated at 28, the sheaths providing good purchase for the loop wires and preventing rubbing, squeaking, or grating wire noises between the wires. The end portions of the wire extend from the respective side strands, extending first upwardly, then inwardly and downwardly, terminating in sharpened claw teeth 30. The terminal portions of the wire forming said teeth converge inwardly and downwardly, meeting at a point lying in the vertical plane of a midline between side strands 18, and spaced above central portion 26 of the wire. For purposes of definition, said strands 18 and central portions 26 of the wire loops may be denoted as a support structure, which carries claw teeth 30. For reasons which will appear, the terminal wire portions forming teeth 30 diverge upwardly to a transverse spacing at least as great as the base width of pad groove 6. The mid-portion of central portion 26 of each wire loop is arcuately offset downwardly, as indicated at 32.

In operation it will be understood that retainer assembly 10 is molded into pad 2, at the time of manufacture of the pad, so as to extend along the bottom of groove 6 of said pad, with claw teeth 30 as closely disposed as possible to the base of groove 6, as shown in FIG. 1. Listing wire 14 is hemmed into the fold 12 of the trim sheet by stitching 16, all necessary listing wires being hemmed into the trim sheet before application of the trim sheet to the pad. After initially laying the trim sheet over the pad, a listing wire 14 may have the relationship to a groove 6 of the pad as shown also in FIG. 1. Then with the fingers or any suitable tool, the listing wire is pressed firmly into the bottom of the groove until it divides the padding material at the base of the groove, forces the claw teeth 30 of each pair of said teeth resiliently apart in a direction transverse to the retainer, and passes between and below said teeth. The teeth then recover resiliently, so that their sharpened points are disposed above the listing wire. Said points may or may not initially penetrate the trim sheet listing, although they will eventually do so under the stresses of normal usage, but in any event they cannot pierce the listing wire itself. Thus when the listing wire is released, it cannot pass upwardly between the teeth, and the trim sheet is held firmly and permanently in position. The listing wire has at least three important functions. First, due to its resilient stiffness, it facilitates the insertion thereof between the claw teeth, in that downward pressure at a single point thereof can press it downwardly between several successive pairs of teeth. Second, it provides a more secure engagement of the trim sheet listing by the claw teeth, since it positively prevents the teeth from tearing through the listing itself. Third, its stiffness insures that the lower edge of the listing will remain substantially straight, preventing it from yielding upwardly between successive pairs of teeth, which in turn causes an uneven, unattractive appearance, or "puckering" of the trim sheet on the top surface of the pad. In this connection, the use of the listing wire permits the use of fewer, more widely spaced apart pairs of claw teeth.

The upward divergence of the teeth 30 of each pair, to a spacing at least as great as the base width of pad groove 6, insures that as the listing wire is pressed downwardly into place, it must enter between the teeth of each pair, with no necessity that the operator must consciously "feel for" or "find" the tooth pairs by his sense of touch. The downward offset 32 of central portion 26 of each wire loop has two functions. First, it provides additional vertical clearance between the points of teeth 30 and wire 26, for greater ease in pushing the listing wire downwardly beneath the tooth points, and second, that is disposes a portion of wire length 26 closely adjacent the bottom surface of the pad, where it can be easily engaged by hog rings or other fasteners, piercing the pad, for fastening the pad down to wires or other elements of the seat frame subassembly when desired.

With many types of padding foams, very little if any difficulty is experienced in pressing the listing wire downwardly past the bottom of groove 6 for engagement by the claw teeth described in connection with FIG. 2, although this involves pressing said listing wire through a thin section of the foam itself. This ease of insertion results from the extreme local fragility of many types of foam, or in other words from its extremely low resistance to tearing. However, some foams may be sufficiently tough to make insertion of the listing wire difficult, and in such cases it may be preferable to form the pad groove 6 as shown in FIGS. 4 and 5. As there shown, the groove extends downwardly, along most of its length, to a level well below the points of teeth 30, leaving only a narrow slab 34 of foam at intervals along its length, each only of sufficient bulk to contain the points of teeth 30 of one of wire loops 20. Leaving the teeth completely exposed in the groove is not practical in view of the requirements of a mold in which to form the pad. However, the listing wire may be pressed downwardly very easily through the very thin bulk of slabs 34.

FIGS. 6 and 7 show a modification of the retainer assembly 10 which differs from that shown in FIGS. 1 – 5 in that central section 26 of each wire loop 20 passes beneath rather than above side strands 18, which increases the vertical clearance thereof below teeth 30 and also places wire section 26 closer to the bottom surface of the pad, so that the downward offset 32 of FIGS. 1 – 5 is not necessary, in that the wrapping 28 of wire 20 around the side strands 18 includes more than 1½ turns, rather than less than 1 full turn as in FIGS. 1 – 5, which provides greater strength and security of assembly, and in that the wire ends forming teeth 30 are inclined upwardly and inwardly, then downward and inwardly, in angled form rather than curved as in FIGS. 1 – 5.

The retainer modification shown in FIGS. 8 and 9 differs from that of FIGS. 6 and 7 in that side strands 18 are disposed at the tops of the downwardly and inwardly inclined portions of the teeth, rather than at the extreme laterally opposite sides of the assembly, which for reasons not here shown or pertinent, may be advantageous in supporting the retainer in a mold while the foam is poured thereabout, and in that the teeth 30 are crossed in X-form (see FIG. 9) rather than simply meeting, which may be of assistance in better engaging certain types of trim sheet listing, as will appear. This form of the retainer may also require an auxiliary strand 36 extending parallel to side strands 18, and positioned at the midpoints of the wires forming loops 20, to preserve loop central portions 26 at a uniform spacing. Auxiliary strand 36 may be formed of twisted paper only, with no wire core, and be pierced by each wire at its point of intersection therewith.

FIG. 14 shows a modification of the retainer assembly which is identical in all respects to that shown in FIGS. 1 – 5 except that one or both (one shown) of side strands 18 is arcuately offset outwardly, as at 38, between each successive pair of wire loops 20. These offsets impart a degree of longitudinal resilient yieldability to the side strand, and hence permit the assembly to be flexed laterally in the plane of the side strands. This permits the assembly to be curved horizontally to lie properly at the base of a non-straight groove 6 of the pad, as may be useful and desirable in certain types of seating designs. Alternatively, the FIG. 14 modification could be originally manufactured with both of side strands 18 straight, and offsets 38 then introduced to provide the desired curvature.

FIGS. 10 – 13 show various types of listing constructions. When, as shown in FIGS. 1 – 3, the listing 8 comprises simply a double fold of the trim sheet itself, with listing wire 14 secured in place only by a single line of stitching 16, the sheer depth of the fold may cause it to collect dirt and debris, which can be difficult to remove. To prevent this, the fold layers of the trim sheet may be secured together by a second line of stitching 40, parallel to stitching 16 but spaced thereabove, as shown in FIG. 10, so to be disposed substantially at the mouth of pad groove 6. If stitching 40 is used, the entire trim sheet must be laid at one side of the pad groove while listing wire 14 is being pressed into engagement with the claw teeth.

FIG. 11 shows a listing identical to that of FIG. 10 except that in place of listing wire 14, the fold 12 of the trim sheet is simply folded on itself and secured by stitching 42. This provides a cord-like enlargement at the bottom edge of the listing which may be engaged quite satisfactorily by the claw teeth, but does not provide other advantages of the listing wire, the use of which is preferred. The retainer of FIGS. 8 and 9, with the teeth 30 crossed, is particularly useful with this type of listing.

FIG. 12 shows a listing in which a narrow listing sheet 44 of tough but inexpensive fabric or the like is attached at its upper edge, as by stitching 46, directly to trim sheet 4, and has a listing wire 14 hemmed in its lower edge by stitching 48.

FIG. 13 shows a listing identical to that shown in FIG. 12 except that in place of listing wire 14, an extruded form 50 of tough plastic is connected to listing sheet 44 by stitching 52. In cross-sectional contour, form 50 has the shape of a downwardly directed arrow, as shown, with barbs 54 extending laterally in opposite directions. When the point of the arrow head is pressed downwardly between the pairs of teeth 30, it cams the teeth apart, and when the teeth recover elastically, their points engage the top surfaces of barbs 54 to secure them against withdrawal.

FIG. 15 shows a modification of the retainer assembly generally similar to that of FIGS. 8 - 9 except that teeth 30 do not cross but merely meet, auxiliary strand 36 is dispended with, and the wire of loop 20 is wrapped about side strands 18 in a reverse direction as compared to FIGS. 8 - 9. The merely "meeting" relation of the teeth decreases the pressure required to insert the listing therebetween. Also, the reverse winding of wire 20 about the side strands provides that insertion of the listing tends to "unwind" the wire from said side strands, and this further reduces the insertion pressure required. On the other hand, any pressure tending to withdraw the listing from between the teeth tends to "wind" the wire still more tightly on the side strands, thereby increasing the holding power of said teeth.

It will also be readily apparent that, while illustrated in the drawing as embedded in a form seat cushion pad, the present retainer also has other general utility in securing upholstery trim or cover sheets to other seating elements. For example, the central portions 26 of wire loops 20 could be stapled or otherwise secured to the side, front and rear rails of seating frames, with teeth 30 thereof left exposed and so oriented as to receive and retain the extreme edges of a cover or trim sheet therebetween.

While I have shown and described certain specific embodiments of my invention, it will be readily apparent that many minor changes of structure and operation could be made without departing from the spirit of the invention.

What I claim as new and desire to protect by Letters Patent is:

1. In combination with an upholstered seat assembly including a pliable trim sheet assembly covering a foam seat cushion pad of said seat assembly, said pad having a deep groove formed in the top surface thereof along a line thereof along which said trim sheet assembly is to be secured thereto, and said trim sheet assembly having a listing portion extending along said line and depending into said groove, a retainer assembly for securing said trim sheet assembly to said pad, said retainer assembly comprising:

a. an elongated support structure molded in said pad generally along the base of said groove, and b. a series of pairs of resilient claw teeth mounted on said support structure in spaced relation along the length thereof, the teeth of each of said pairs being laterally spaced relative to said groove and meeting substantially at the longitudinal midline thereof, whereby when said listing portion of said trim sheet assembly is pressed into said groove and between said pairs of teeth, it forces the teeth of each of said pairs of teeth resiliently apart, whereupon the elastic recovery of said teeth causes the points of said teeth to engage and retain said trim sheet listing therebetween.

2. A retainer assembly as recited in claim 1 wherein said claw teeth are slender and elongated, each pair thereof having portions thereof converging laterally of said groove toward their meeting point in the direction of insertion of said listing, whereby insertion of said listing between said covergent tooth portions will cam said teeth laterally apart.

3. A retainer assembly as recited in claim 2 wherein each of said pairs of teeth diverge from their meeting point to a spacing at least as great as the transverse width of said groove, whereby to guide the listing between said teeth as it is inserted.

4. A retainer assembly as recited in claim 1 wherein the meeting ends of each of said pairs of claw teeth are sharpened, whereby to facilitate penetration of said listing thereby.

5. A retainer assembly as recited in claim 1 wherein said support structure comprises:

a. a pair of horizontally spaced apart, generally parallel said strands, and b. connecting members extending laterally between and joining said side strands, the claw teeth of each of said pairs of claw teeth being affixed respectively to said side strands, each of said teeth comprising a length of resilient wire affixed at one end to its associated side strand, and extending therefrom to form one of said teeth, the free ends of the teeth of each pair meeting in the plane of a line midway between said side strands.

6. A retainer assembly as recited in claim 5 wherein each of said connecting members comprises a length of resilient wire, extending generally horizontally between and secured at its ends to said side strands.

7. A retainer assembly as recited in claim 6 wherein each of said side strands comprises a resilient wire core having a sheath of soft, indentable material, and wherein the resilient wires forming each of said claw teeth, and each of said connecting members, is secured to each of its associated side strands by securing it tightly about the sheath of said side strand, said sheath serving to prevent rubbing or grating noises resulting from contact between the wires of the assembly.

8. A retainer assembly as recited in claim 5 wherein the teeth of each of said pairs of claw teeth, together with one of said connecting members, constitute a single divided loop formed by a single length of resilient wire, the wire ends at the division of said loop constituting said claw teeth, and wherein said support structure comprises a plurality of resilient strands extending longitudinally of said assembly and transversely to the planes of said wire loops, each of said support structure strands being secured to each of said wire loops at a point thereof circumfuentially spaced apart from the tooth portions thereof.

9. A retainer assembly as recited in claim 8 wherein each of said support structure strands comprises a spring wire core having a sheath of soft, indentable material, and wherein each of said wire loops is secured to each of said support structure strands by securing a portion of the former tightly about the sheath of the latter.

10. A retainer assembly as recited in claim 1 additionally including a resilient wire affixed to said trim sheet listing at the edge thereof depending into said groove, and parallel to said groove, said listing wire facilitating the engagement and retention of said listing by said claw teeth.

* * * * *